United States Patent [19]

Valoff

[11] 4,069,525

[45] Jan. 24, 1978

[54] FIRM FOUNDATION UNIT FOR MATTRESSES

[75] Inventor: Bob S. Valoff, Cerritos, Calif.

[73] Assignee: Ideal Spring Company, Los Angeles, Calif.

[21] Appl. No.: 730,528

[22] Filed: Oct. 7, 1976

[51] Int. Cl.[2] ..... A47C 23/02

[52] U.S. Cl. ..... 5/247; 5/255; 5/257; 267/105

[58] Field of Search ..... 5/247, 248, 255, 260, 5/267, 351, 354; 267/80, 91, 100, 102, 103

[56] References Cited

U.S. PATENT DOCUMENTS

| | | | |
|---|---|---|---|
| 212,443 | 2/1879 | Crich | 5/264 B |
| 3,681,794 | 8/1972 | Ciampa et al. | 5/247 |
| 3,725,965 | 4/1973 | Smith et al. | 5/247 |
| 3,825,960 | 7/1974 | Inman et al. | 5/260 |
| 3,833,948 | 9/1974 | Surle Ha et al. | 5/260 |
| 4,000,531 | 1/1977 | Inman | 5/267 |
| 4,012,801 | 3/1977 | King et al. | 5/247 |
| 4,012,803 | 3/1977 | Hutchinson et al. | 5/247 |

*Primary Examiner*—Casmir A. Nunberg
*Attorney, Agent, or Firm*—William P. Green

[57] ABSTRACT

A mattress supporting foundation unit which is constructed to offer very firm support to a mattress, and which includes a base frame, a horizontal wire mesh spaced above the frame, and support wires for connecting the mesh to and supporting it from and above the frame, with these support wires having portions forming legs which extend upwardly from the base to the mesh and are substantially straight for their entire length between the base and mesh to give the desired rigidity to the overall structure. The support wires desirably also have connector portions which extend laterally between successive legs and are attached to the base and mesh.

15 Claims, 7 Drawing Figures

FIRM FOUNDATION UNIT FOR MATTRESSES

BACKGROUND OF THE INVENTION

This invention relates to improved foundation units for supporting mattresses.

In recent years, most orthopedic specialists and other medical and health authorities have advised the use of mattresses which offer very firm support to a user's body. In line with this trend toward firmer mattresses, some manufacturers have commenced to offer foundation units to be used beneath a mattress in lieu of the usual flexible box spring structure but which are themselves firmer than a conventional box spring. For example, in one prior arrangement the foundation unit has included a hollow rigid wooden box, which may carry a thin layer of padding at its upper side, all enclosed within a suitable covering, to provide a support of substantially no flexbility for a superimposed mattress.

SUMMARY OF THE INVENTION

A foundation unit embodying the present invention can be dimensioned to have the same vertical thickness and other size characteristics as a conventional box spring, but is very firm in resisting deformation in use, and therefore in conjunction with a firm mattress will afford optimum support to a user's body. At the same time, a unit embodying the invention does have a limited capacity for relatively slight downward deflection of its upper surface, to avoid the excessive rigidity which may result when a simple wooden box is employed, and to avoid excessive wear on the mattress which may be caused by too much rigidity in the foundation unit. Further, a foundation structure constructed in accordance with the invention can be much lighter in weight and easier to handle than the usual box spring assembly or a hollow wooden box arrangement, and can be more economical to produce and therefore less expensive to the consumer.

Structurally, a foundation unit embodying the invention includes a horizontal base frame which may be formed of wood, a horizontal mesh preferably formed of wire and spaced above the frame, and a unique support structure connecting the mesh to and supporting it from the frame. This support structure is formed of an elongated material, desirably wire of appropriate strength, shaped to provide a plurality of legs which extend upwardly from the base frame and are connected at their upper ends to the mesh. These legs are substantially straight along their entire length from the frame to the mesh, and preferably extend approximately directly vertically, though certain of the legs may be disposed at a small angle to the true vertical in order to be inclined slightly outwardly as they advance upwardly, to connect to the mesh at its periphery while connecting to the frame in effective manner at a location spaced slightly inwardly from its peripheral edge.

The elongated support elements or wires are also shaped to provide, in addition to the legs, connector portions which extend laterally between and integrally connect corresponding ends of successive legs. Desirably, such connector portions are provided at both the upper and lower ends of the legs, for attachment to the mesh and frame respectively, with a first pair of legs of a particular support wire or element being joined together by a connector portion at their upper ends, while one of these legs and a third leg are integrally joined by a connector portion at the lower ends of the legs, etc. to provide a simple one piece wire effectively interconnecting the frame end mesh in fixed relative positions. For best results, a plurality of such elongated wire support elements extend in different directions, for example, transversely and longitudinally of the bed, so that the rigidity offered by some of these elements in one direction will be supplemented by rigidity offered by others of the elements primarily in another direction to optimize the strength and firmness of the overall assembly.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
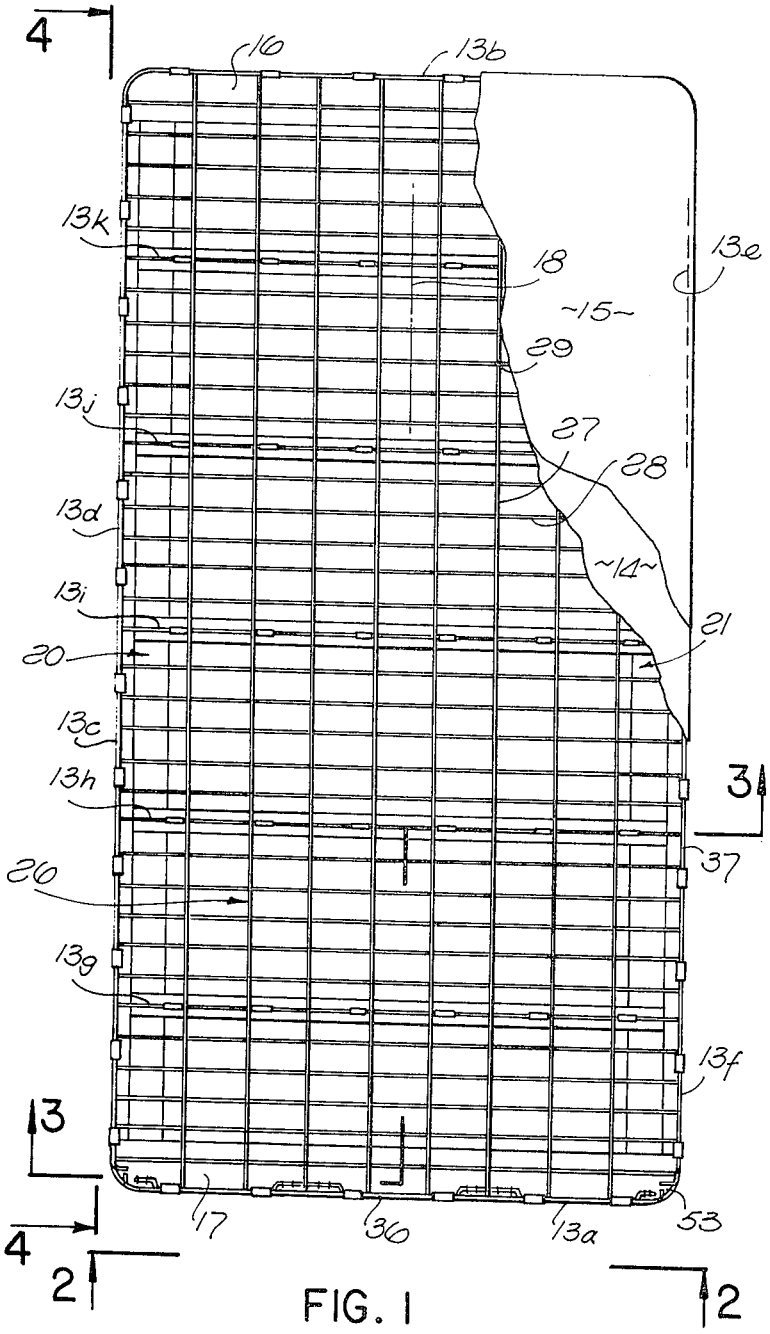
FIG. 1 is a plan view of a mattress foundation unit constructed in accordance with the invention, with the upper padding and cover broken away to reveal the interior construction of the unit.
Figure 2:
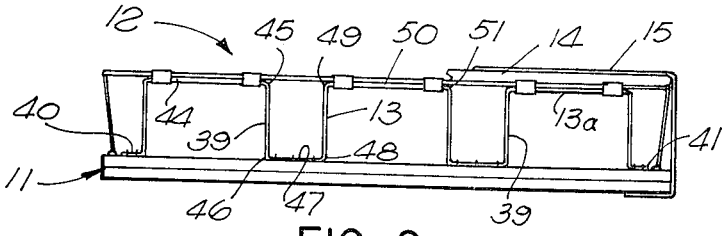
FIG. 2 is an end elevational view taken on line 2—2 of FIG. 1.
Figure 3:
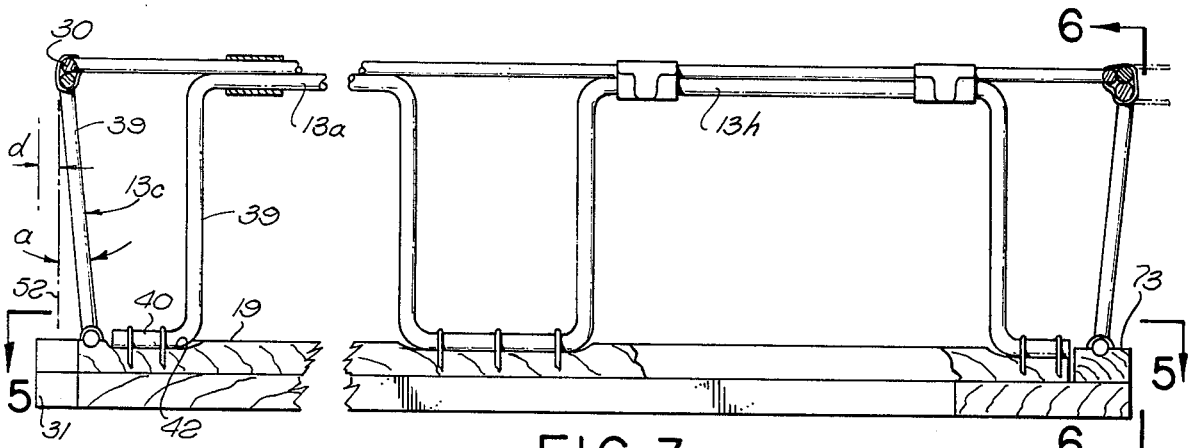
FIG. 3 is a transverse vertical section taken on lin 3—3 of FIG. 1.

Referring first particularly to FIGS. 1, 2 and 3, the mattress foundation unit 10 shown in those figures includes a horizontal rectangular wooden base frame 11, an upper horizontal structure 12, and a plurality of preferably identical wire support elements extending between and interconnecting structures 11 and 12 and designated separately in the figures by the numbers **13*a*, 13*b*, 13*c*, 13*d*, 13*e*, 13*f*, 13*g*, 13*h*, 13*i*, 13*j* and 13*k*. A layer of padding 14 extends across the top of upper structure 12 and downwardly a short distance at its sides, with the entire assembly being enclosed within a cloth cover 15 extending across the top of the pad, downwardly at the sides of the structure, and inwardly at the bottom of base frame 11** for attachment thereto.

The base frame 11 may include two identical boards 16 and 17 at the head and foot ends respectively of the unit, and disposed essentially transversely of the longitudinal axis 18 of the unit. These boards 16 and 17 have upper horizontal surfaces 19 to which the support wires 13 are attached. At their opposite ends, boards 16 and 17 are connected to two wooden opposite side rails 20 and 21 of frame 11, with these side rails extending essentially parallel to longitudinal axis 18 of the unit and having their ends received beneath and nailed rigidly to the undersides of members 16 and 17. The overlapping ends of members 16, 17, 20 and 21 may be rounded at the four corners of the unit, as illustrated at 22. The head and foot boards 16 and 17 may be reinforced by wooden members 23 nailed to the undersides of boards 16 and 17, and extending between the two side rails 20 and 21. Two elongated boards 73 may extend along the outer peripheral edges of side rails 20 and 21, having their opposite ends terminating adjacent end boards 16 and 17 respectively, with these members 73 being rigidly secured to the side rails by nailing. The upper surfaces 24 of members 73 are horizontal, and lie in the same horizontal plane as upper surfaces 19 of end members 16 and 17. At locations intermediate the head and foot boards 16 and 17, frame 11 includes a number of additional wooden transverse members 25, whose opposite ends are supported on and nailed to side rails 20 and 21 respectively, and whose upper surfaces are horizontal and lie in the same plane as the previously mentioned surfaces 19 and 24.

The upper structure 11 includes a horizontal wire mesh 26, which is formed of spaced longitudinal wires 27 extending parallel to axis 18, and spaced transverse wires 28 extending perpendicular to axis 18. These wires 27 and 28 may be welded together at their intersections 29, and may be formed of a very inexpensive low carbon steel which has some deformability but need not be spring steel or have resilience. Preferably, the type of wire employed in mesh 26 is that commercially known and sold as "bright basic wire" made of 1017 steel.

In addition to the mesh 26, the top structure 12 includes also a peripheral wire or rod 30, which is bent to define essentially a rectangle having substantially the same horizontal outline configuration as the peripheral edge 31 of the wooden frame 11, but slightly smaller than the rectangle defined by edge 31, so that as seen in FIG. 3 for example the wire 30 is at all points spaced a short distance *d* inwardly from the vertical plane in which a corresponding portion of outer edge surface 31 of the wooden frame lies. This slightly inwardly spaced relationship of wire 30 with respect to the frame surface 31 exists along the transverse portions 36 of peripheral wire 30 which extend across the head and foot ends of the unit, perpendicular to axis 18, and exists also along the longitudinal side portions 37 of peripheral wire 30 which extend parallel to axis 18. At the four corners of the unit, the peripheral wire 30 may be curved in correspondence with the curvature of the previously mentioned corner surfaces 22 of the wooden frame (but spaced slightly inwardly with respect to surfaces 22). The distance *d* that the peripheral wire 30 is spaced inwardly with respect to edge 31 of the frame may be just sufficient to allow reception of a portion of the padding 15 outwardly of the peripheral wire, and in particular may for example be one-fourth of an inch. The peripheral wire 30 may be formed of steel of the same low carbon type utilized in forming mesh 26, but of a substantially larger gauge to have greater strength and rigidity than the wire from which the mesh is formed. It is currently felt desirable that peripheral wire 30 be formed of six gauge steel. This wire may be bent to the desired rectangular configuration, and be formed of one or more lengths of wire appropriately welded at their ends to form in effect a continuous rectangle. The mesh is suitably secured at its periphery to wire 30, desirably by dimensioning the mesh so that two of its longitudinal wires 27 are received adjacent and in contact with and extend along the longitudinal side portions 37 of peripheral wire 30, while two of the transverse wires 28 of the mesh extend along and are secured to the transverse portions 36 of peripheral wire 30. This attachment may be made by placing a series of metal clips 38 about the peripheral wire and adjacent mesh wire and clamping these clips tightly thereagainst to secure these wires together. As will be brought out at a later point, the same clips 38 may also extend about portions of the wire which forms elements 13*a*, 13*b*, etc. to at the same time secure these parts to the upper structure.

Referring now to FIG. 2, the support wire 13*a* at the foot end of the foundation unit is formed of wire having substantial rigidity and preferably of the same low carbon steel of which the upper mesh and peripheral wire 30 are formed. It is found that support element 13*a* and the other identical support elements may be formed of the same gauge wire as is utilized in peripheral wire 30 of the upper structure, typically six gauge wire. This wire of element 13*a* is deformed to the shape illustrated in FIG. 2, to form a series of parallel support legs 39 which are connected at their lower ends to frame 11 and at their upper ends to upper structure 12, and are straight along essentially their entire length between frame 11 and upper structure 12. At its opposite ends, the wire forming member 13*a* has horizontally turned terminal portions 40 and 41, which are received partially in shallow elongated grooves 42 formed in the upper surface of frame member 17, and are retained in those grooves in fixed positions by staples 43 curving about and engaging the upper side of portions 40 & 41 and driven downwardly into the wood of member 17 at opposite sides of grooves 42. To describe the end view configuration of member 13*a* as seen in FIG. 2, commencing with the left end terminal portion 40, the wire member 13*a* first extends upwardly from member 40 to form a first of the legs 39, and then extends rightwardly along and parallel to and adjacent peripheral wire 30 at 44 to a location 45 at which the wire extends downwardly to form a second of the legs 39. At the lower end of that leg, the wire bends rightwardly at 46 to form a second horizontal portion 47 of member 13*a* partially received within a groove 42 in the wooden frame member 17, and secured rigidly therein by staples 49′ driven into the wood of member 17. At the right end of the horizontal connector portion 47, the wire again turns upwardly at 48, to form a third of the legs 39, at whose upper end the wire curves rightwardly at 49 to form a second upper connector portion 50 extending horizontally along and parallel to peripheral wire 30, in engagement therewith, to ultimately bend downwardly at 51 to form the next successive leg 39. This pattern of legs and horizontal connector portions is repeated along the entire length of the part 13*a*, until a final one of the approximately vertical legs 39 is connected to the right hand terminal horizontal mounting portion 41 of FIG. 2 which is secured to the base frame as discussed.

Figure 5:
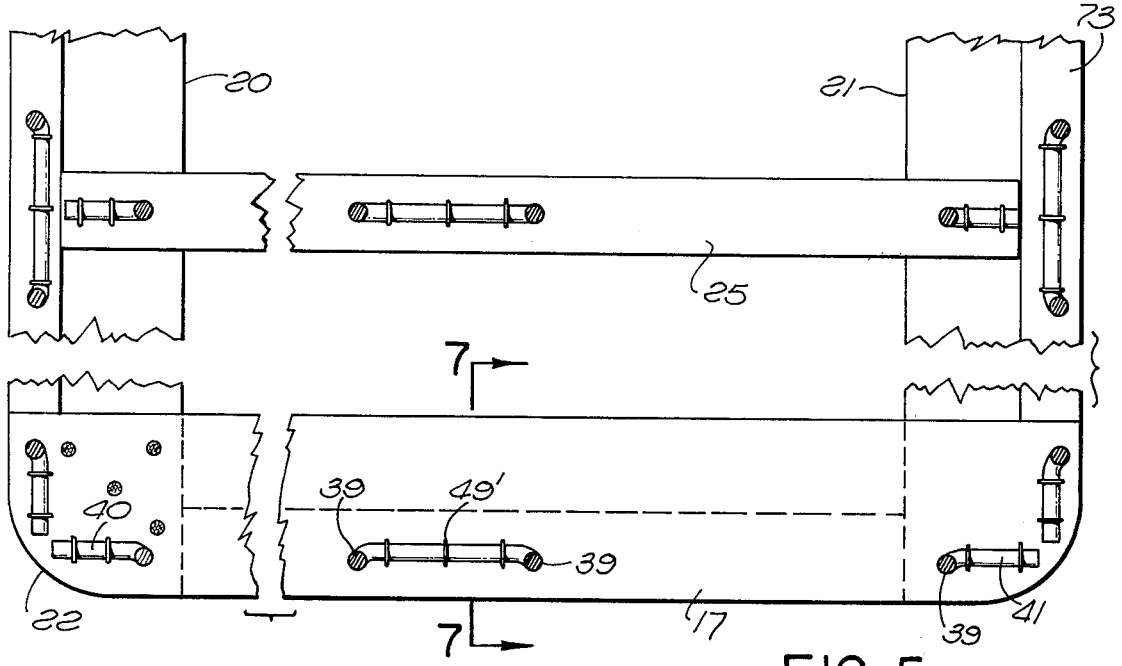
FIG. 5 is an enlarged fragmentary horizontal section taken on line 5—5 of FIG. 3.

The upper horizontal connector portions 44, 50, etc. of element 13*a* may be secured to peripheral wire 30 and the mesh by the same clips 38 which secure the peripheral wire and mesh themselves together. For this purpose, the clips may extend about all three of these parts, and may be preshaped to have partial cylindrical portions closely embracing the connected wires and effectively holding connector portions 44 etc. directly beneath peripheral wire 30. This configuration of the clips is illustrated in the right hand portion of FIG. 5. As will be understood, the clips are not circularly continuous, but are interrupted at a location (as illustrated in FIG. 3) in a manner enabling the open clips to be slipped onto and then clamped tightly about and against the contained wires.

The support wire 13*b* (FIG. 1) at the head of the foundation unit is identical with wire 12*a*, and is connected to the frame and the head portion of peripheral wire 30 in the same manner. Similarly, each of the side wires 13*c*, 13*d*, 13*e* and 13*f* may be identical with the wire 13*a* which has been described in detail, and in a single bed size foundation unit two such wires 13*c* and 13*d* of exactly the same length as the end wires 13*a* and 13*b* will together be of a combined length to extend along the side of the foundation unit. These wires 13*c*, 13*d*, 13*e* and 13*f* are secured to the wooden frame in the same manner discussed in connection with wire 13*a*, having the lower portions of each of the wires partially received within grooves in the wooden frame and retained therein by staples, and having the upper horizontal connector portions secured to peripheral wire 30 by clips identical with the described clips 38. The additional support wires 13*g*, 13*h*, etc., which are parallel to but between wires 13*a* ad 13*b* are connected to the upper sides of the cross boards or slats 25 in the same manner that wire 13*a* is connected to end board 17. The upper horizontal portions of wires 13*g*, 13*h*, etc., corresponding to portions 44 and 50, etc. of member 13*a*, are secured to some of the transverse wires 28 of upper mesh 26, by clips 38*a* similar to the previously described clips 38.

Figure 7:
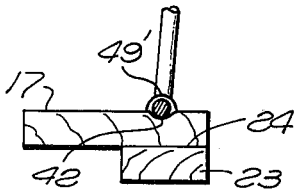
FIG. 7 is a fragmentary vertical sectional view taken on line 7—7 of FIG. 5.

As seen in FIG. 3, the legs 39 of support wire 13*c*, while being straight along their entire vertical length and being disposed approximately directly vertically for optimum transmission of load forces therethrough, are desirably not precisely vertical but rather inclined at a slight angle *a* with respect to the true vertical represented at 52, so that the lower longitudinally aligned portions of wire 13*c* (corresponding to portions 40, 41, 47, etc. of wire 13*a* as seen in FIG. 7) may be secured to the wooden frame 11 at a location spaced inwardly a substantial distance from its peripheral edge surface 31 while the upper portions (corresponding to portions 44, 50 etc. of FIG. 7) may be secured to peripheral wire 30 at a location spaced slightly laterally outwardly with respect to the lower portions. This small angularity represented by the angle *a* of FIG. 3 should not be more than a very few degrees, say for example not more than about four degrees.

Figure 4:
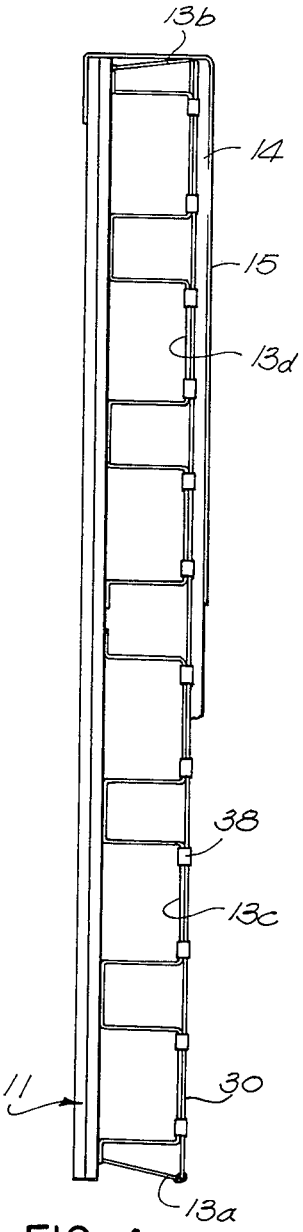
FIG. 4 is a side elevational view taken on line 4—4 of FIG. 1.
Figure 6:
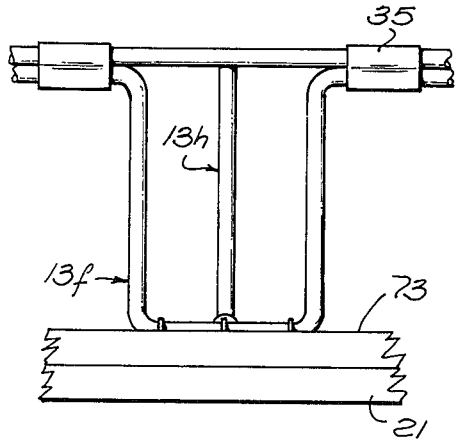
FIG. 6 is a fragmentary side elevational view taken on line 6—6 of FIG. 3.

The wires 13*a* and 13*b* at the foot and head ends of the foundation unit are similarly inclined slightly outwardly as they advance upwardly, and the same is true of the other side support wires 13*c*, 13*d*, 13*e* and 13*f*. The longitudinally intermediate support wires 13*g*, 13*h*, etc., however, need not have such an inclined relationship with respect to the true vertical, but rather desirably have their legs 39 disposed exactly vertically as seen in FIGS. 4 and 6. At teach of the four corners of the upper structure 12, two of the wires forming mesh 26 may have their ends wrapped about the corresponding curved corner portion of peripheral wire 30, as represented at 53 in FIG. 1.

After the wood and wire assembly has been constructed to the form illustrated in the figures, the padding 14 and cover 15 are secured thereto, and the device may then be utilized in the same manner as a conventional box spring, with the wooden frame 11 resting on the angle irons of a bed frame, and with a mattress being supported on the upper surface of the foundation unit. In use, the upper mesh 26 is able to flex very slightly in response to the imposition of load forces thereon through the mattress, but not sufficiently to permanently deform the wires of the mesh. The vertical or approximately directly vertical legs 39 of the various support elements 13*a*, 13*b*, 13*c*, etc. are rigid enough to avoid flexure in use, and thus support the upper structure 12 substantially rigidly, giving an extremely firm support to a superimposed mattress. This rigidity and firmness is enhanced by the fact that some of the support elements 13 extend transversely of axis 18 (for example wires 13*a*, 13*b*, etc.) while others (side elements 13*c*, 13*d*, etc.) extend essentially longitudinally with respect to axis 18 and perpendicular to the transverse wires, so that these relatively perpendicular support elements complement one another in a manner giving the overall assembly optimum strength and rigidity with minimum weight.

While a certain specific embodiment of the present invention has been disclosed as typical, the invention is of course not limited to this particular form, but rather is applicable broadly to all such variations as fall within the scope of the appended claims.

I claim:

1. A foundation unit for supporting a mattress, comprising:

an essentially horizontal base frame having side rails extending along opposite sides thereof longitudinally of the frame, and having cross members extending transversely between said side rails at head and foot ends thereof and therebetween;

an essentially horizontal upper structure spaced above said frame and including a horizontal mesh of intersecting and interconnected longitudinal and transverse wires, and a peripheral wire of greater strength extending about and connected to the periphery of said mesh;

a plurality of supporting units connecting said upper structure to and supporting it from said frame and each formed of a continuous strip of wire bent to form a series of legs which extend approximately directly vertically from the frame to said upper structure at different locations and are connected at lower ends to the frame and at upper ends to said upper structure, and which are substantially straight for the entire distance from the frame to the upper structure, each of said continuous strips of wire forming a plurality of essentially horizontal connector portions each extending laterally between and integrally interconnecting corresponding ends of two successive legs of the same strip;

certain of said continuous strips extending along said opposite side rails and having alternate connector portions of an individual strip attached to a side rail and said peripheral wire of said upper structure respectively;

others of said continuous strips of wire extending transversely along said cross members at the head and foot ends respectively of the foundation unit and each having alternate connector portions attached to a cross member and said peripheral wire respectively;

additional ones of said continuous strips of wire being disposed along cross members at locations longitudinally intermediate the head and foot ends of said frame and each having alternate connector portions attached to a cross member and said mesh respectively.

2. A foundation unit as recited in claim 1, in which said frame is formed of wood and has recesses at its upper side at least partially receiving said connector portions of said continuous strips of wire, there being staples driven into said wood and bridging across said connector portions to retain them in said recesses.

3. A foundation unit as recited in claim 2, in which the legs of said continuous strips of wire which extend along said side rails and the cross members at the head and foot end of the frame have their lower ends spaced slightly inwardly of the periphery of the frame and are inclined to advance slightly outwardly with respect to the true vertical as they advance upwardly to points of connection to said peripheral wire of the upper structure.

4. A foundation unit as recited in claim 3, in which each of said continuous strips of wire has two horizontally turned ends at opposite extremities of the strip and at lower ends of two of the legs of that strip, and which turned ends are at least partially received within recesses formed in the upper surface of said frame, there being staples driven into the frame and bridging across the upper sides of said turned ends to retain them in the coacting recesses.

5. A foundation unit as recited in claim 4, including a plurality of clips each clamped about and securing together said peripheral wire of the upper structure and one of said wires of the mesh and an upper one of said connector portions.

6. A firm foundation unit for supporting a mattress, comprising:

an essentially horizontal and essentially rectangular base frame having side rails extending along opposite sides thereof longitudinally of the frame, and having cross members extending transversely between said side rails;

an essentially horizontal upper structure spaced above said frame and including a horizontal mesh of intersecting wires, and a peripheral wire of greater strength connected to the periphery of said mesh;

a plurality of supporting units connecting said upper structure to and supporting it from said frame and each formed of a continuous strip of wire bent to form two spaced substantially parallel legs which extend upwardly approximately directly vertically from the frame to said upper structure and are connected at lower ends to the frame and at upper ends to said upper structure, and which are substantially straight for substantially the entire distance from the frame to the upper structure so that most of the weight of a mattress and a person on the foundation unit is taken by the wire legs in compression;

each of said continuous strips of wire forming a horizontal connector portion interconnecting corresponding ends of said two spaced approximately vertical legs of the same strip of wire.

7. A firm foundation unit as recited in claim 6, in which said connector portions of some of said strips extend along and are secured to said peripheral wire of said upper structure, said strips having horizontally turned portions at the lower ends of said legs connected to said side rails and cross members of the base frame.

8. A firm foundation unit as recited in claim 6, in which certain of said legs have their lower ends connected to said frame at a location spaced slightly inwardly from the periphery thereof, and have their upper ends connected to said peripheral wire of the upper structure at a location offset slightly laterally outwardly with respect to said location of attachment of the lower ends of the legs, so that said certain legs, while approximately vertical, are disposed at a slight outward angle to the true vertical as they advance upwardly.

9. A firm foundation unit as recited in claim 6, in which certain of said connector portions which interconnect lower ends of the legs are at least partially received and retained within recesses formed in the upper surface of said frame.

10. A firm foundation unit as recited in claim 6, in which said strips of wire have portions at the lower ends of said legs which are turned generally horizontally are received at least partially within recesses in the upper surface of said frame.

11. A firm foundation unit as recited in claim 6, in which said connector portions of said strips of wire extend along and are secured to said peripheral wire of said upper structure, said strips of wire having portions at the lower ends of said legs which are turned generally horizontally and are received at least partially within recesses in the upper surface of said frame, there being retaining elements connected to said frame and extending across the upper sides of said generally horizontally turned portions to retain them in said recesses.

12. A firm foundation unit as recited in claim 6, in which a single continuous strip of said wire is shaped to form at least three of said legs and two of said connector portions extending between corresponding ends of successive legs, with one of said connector portions being attached to said frame and the other being attached to said mesh.

13. A firm foundation unit as recited in claim 6, in which some of said wire strips have said connector portions thereof extending longitudinally of said frame and said legs thereof spaced apart longitudinally of the frame, and others of said wire strips have said connector portions thereof extending and said legs thereof spaced apart transversely of the frame so that the different strips complement one another in resisting displacement of said mesh in different directions respectively.

14. A firm foundation unit as recited in claim 6, in which said strips of wire include a plurality of first strips each forming a plurality of said legs and a plurality of said connector portions and extending essentially transversly of said frame, and a plurality of second strips each forming a plurality of said legs and a plurality of said connector portions and disposed essentially longitudinally of said frame.

15. A firm foundation unit as recited in claim 6, in which some of said strips of wire are located at the periphery of the frame and have their legs, while approximately directly vertical, inclined very slightly outwardly as they advance upwardly, others of said strips being spaced inwardly from the periphery of said frame and having their legs disposed more precisely vertical.

* * * * *